US010989395B2

(12) United States Patent
Zou et al.

(10) Patent No.: US 10,989,395 B2
(45) Date of Patent: Apr. 27, 2021

(54) LED LIGHTING FIXTURE, LENS MODULE AND LAMP FASTENER

(71) Applicant: OPPLE LIGHTING CO., LTD., Shanghai (CN)

(72) Inventors: Donghong Zou, Shanghai (CN); Guolong Ni, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/834,356

(22) Filed: Mar. 30, 2020

(65) Prior Publication Data

US 2020/0224859 A1 Jul. 16, 2020

Related U.S. Application Data

(63) Continuation of application No. PCT/CN2018/107378, filed on Sep. 25, 2018.

(30) Foreign Application Priority Data

Sep. 29, 2017 (CN) ..... 201721286879.6

(51) Int. Cl.
*F21V 19/00* (2006.01)
*F21K 9/235* (2016.01)
(Continued)

(52) U.S. Cl.
CPC ..... *F21V 19/003* (2013.01); *F21K 9/235* (2016.08); *F21V 5/04* (2013.01); *F21Y 2115/10* (2016.08)

(58) Field of Classification Search
CPC .. F21V 19/003; F21V 19/001; F21V 19/0035; F21V 19/004
See application file for complete search history.

(56) References Cited

U.S. PATENT DOCUMENTS 8,764,220 B2 * 7/2014 Chan ..... F21V 23/06 362/217.02
2007/0241357 A1 * 10/2007 Yan ..... H01L 33/483 257/98

(Continued)

FOREIGN PATENT DOCUMENTS

CN 206176059 U 5/2017
CN 106939968 A 7/2017

(Continued)

OTHER PUBLICATIONS

International Search Report to PCT Application No. PCT/CN2018/107378, dated Dec. 11, 2018 with English translation, (4p).

*Primary Examiner* — Evan P Dzierzynski
(74) *Attorney, Agent, or Firm* — Arch & Lake LLC

(57) ABSTRACT

An LED lighting fixture, a lens module and a lamp fastener are provided herein. The lamp fastener includes a first clamping lug and a clamp slot configured for fixing a base plate and a lens body of the LED lighting fixture and a second clamping lug configured for clamping an LED light source of the LED lighting fixture onto the lens body. The lens body is connected with the base plate through a first clamping lug and a clamp slot, and the LED light source is clamped on the lens body through a second clamping lug, which, as compared with screwing, consumes less time, and can improve mounting efficiency of the LED lighting fixture, to save time and labor.

15 Claims, 4 Drawing Sheets

(51) Int. Cl.
*F21V 5/04* (2006.01)
*F21Y 115/10* (2016.01)

(56) References Cited

U.S. PATENT DOCUMENTS

| | | | | |
|---|---|---|---|---|
| 2015/0109804 | A1* | 4/2015 | Parekh | F21V 19/004 362/398 |
| 2015/0211719 | A1 | 7/2015 | Moon et al. | |
| 2016/0290571 | A1* | 10/2016 | Chamberlain | F21V 19/004 |
| 2018/0066815 | A1* | 3/2018 | Chen | F21V 31/005 |

FOREIGN PATENT DOCUMENTS

| | | | |
|---|---|---|---|
| CN | 207162163 | U | 3/2018 |
| CN | 107957032 | A | 4/2018 |

* cited by examiner

LED LIGHTING FIXTURE, LENS MODULE AND LAMP FASTENER

CROSS-REFERENCE TO RELATED APPLICATIONS

This application is based upon and claims priority to PCT patent application No. PCT/CN2018/107378 filed on Sep. 25, 2018 which claims the priority of Chinese Patent Application No. 201721286879.6, filed on Sep. 29, 2017, the entire contents of which are incorporated herein by reference.

TECHNICAL FIELD

The present disclosure relates to a technical field of LED lighting fixture, and more particularly, to a lamp fastener as well as a lens module and an LED lighting fixture provided with the lamp fastener.

BACKGROUND

With continuous development of Light Emitting Diode (LED) technologies, LED lighting fixtures with advantages such as low power consumption and long service life have emerged.

There are a variety of LED lighting fixtures, and a common LED lighting fixture includes an LED light source and a lens module for mounting the LED light source, wherein, the lens module includes a base plate to be mounted on a roof or the like, and a lens body connected with the base plate and for mounting the LED light source; the LED light source is adopted for illumination and is protected by the lens body. At present, the lens body is connected with the base plate and the LED light source by screws. When the lens body is mounted on the base plate and the LED light source is mounted on the lens body, a plurality of screws need to be screwed successively, which is time-consuming and labor-intensive.

SUMMARY

Examples of the present disclosure provide a lamp fastener used for a lens module of an LED lighting fixture, for solving the problem that it is time-consuming and labor-intensive to mount the lens body on the base plate and to mount the LED light source on the lens body in the prior art.

In a first aspect, a lamp fastener for an LED lighting fixture according to the present disclosure, including: a first clamping lug and a clamp slot, configured for fixing a base plate and a lens body of the LED lighting fixture; and a second clamping lug, configured for clamping an LED light source of the LED lighting fixture onto the lens body.

In a second aspect, a lens module of an LED lighting fixture according to the present disclosure, including a base plate and a lens body connected with the base plate by a lamp fastener, wherein, the lamp fastener is any one of the lamp fasteners described above.

In a third aspect, an LED lighting fixture according to the present disclosure, including a lens module, and an LED light source provided on the lens module, wherein, the lens module is the lens module described above.

The at least one technical solution adopted in the examples of the present disclosure can achieve advantageous effects as below:

The lens body is connected with the base plate through a first clamping lug and a clamp slot, and the LED light source is clamped on the lens body through a second clamping lug, which, as compared with screwing, consumes less time, and can improve mounting efficiency of the LED lighting fixture, to save time and labor.

BRIEF DESCRIPTION OF THE DRAWINGS

The drawings illustrated here are provided for further understanding the examples of the present disclosure, constituting a part of the present disclosure; the exemplary examples of the present disclosure and description thereof are adopted for explaining the present disclosure, without improperly limiting the present disclosure. In the drawings.

DETAILED DESCRIPTION

In order to make objects, technical solutions and advantages of the present disclosure more clear, the technical solutions of the present disclosure will be described in a clearly and fully way in connection with the specific examples of the present disclosure and the corresponding drawings. It is obvious that the described examples are just a part but not all of the examples of the present disclosure. Based on the examples described herein, those ordinarily skilled in the art can obtain other example(s), without any inventive work, which should be within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Figure 1:
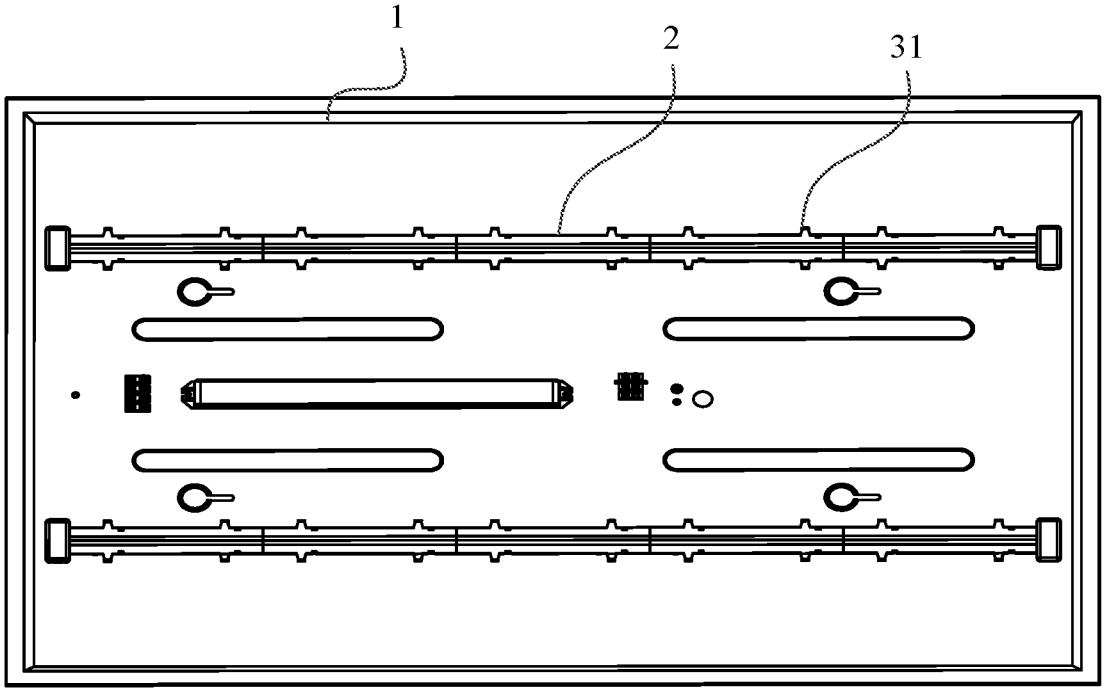
FIG. 1 is a structural schematic diagram of a front surface of an LED lighting fixture provided by an example of the present disclosure.

A lamp fastener according to the present disclosure is adopted for fixing an LED lighting fixture and a lens module. As shown in FIG. 1 and FIG. 5, the LED lighting fixture includes a lens module and an LED light source 5. The lens module includes a base plate 1, and a lens body 2 connected with the base plate 1. The LED light source 5 is connected with the lens body 2. As shown in FIG. 1 to FIG. 6, the lamp fastener includes a first clamping lug 31 for connecting the base plate 1 and the lens body 2, a clamp slot 41, and a second clamping lug 32 for connecting the lens body 2 and the LED light source 5.

The lens body 2, the base plate 1, and the LED light source 5 applied to the lamp fastener can be set as desired. In an example, the base plate 1 is of a rectangular structure, the LED light source 5 is of a strip structure, and the lens body 2 is of a strip structure adapted to the LED light source 5. At least two lens bodies 2 are arranged side by side on a rear surface of the base plate 1, and each lens body 2 is provided thereon with an LED light source 5. Such arrangement is simple in structure and convenient for processing. Of course, the lens body 2 and the LED light source 5 can also have a ring shape, and the base plate 1 can have a circular shape; and so on.

The first clamping lug 31 and the second clamping lug 32 can be provided in various ways, for example, the first clamping lug 31 can be provided on the base plate 1; it can also be provided on the lens body 2. The second clamping lug 32 can be provided on the lens body 2; it can also be provided on other components. Hereinafter, structures of the first clamping lug 31 and the second clamping lug 32 will be described by taking that the first clamping lug 31 and the second clamping lug 32 are both provided on the lens body 2 as an example.

Figure 3:
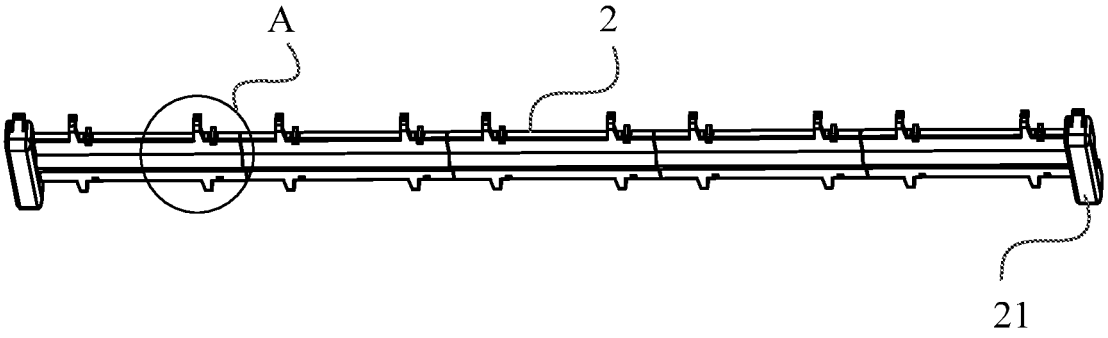
FIG. 3 is a structural schematic diagram of a front surface of a lens body provided with an LED light source provided by the example of the present disclosure.
Figure 4:
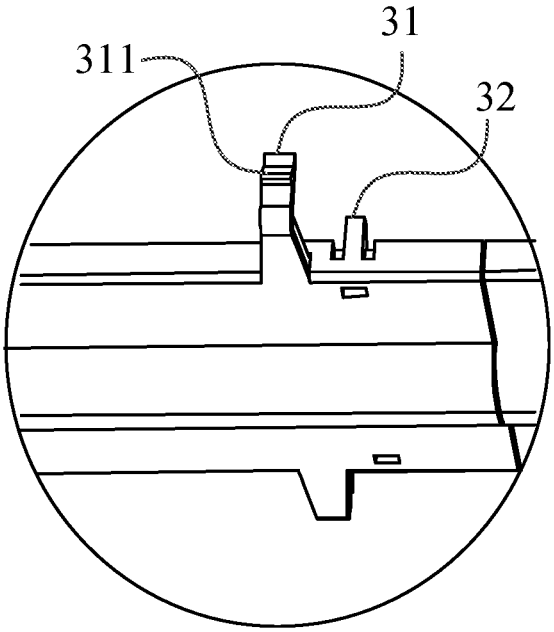
FIG. 4 is an enlarged view of a portion A of FIG. 3.
Figure 5:
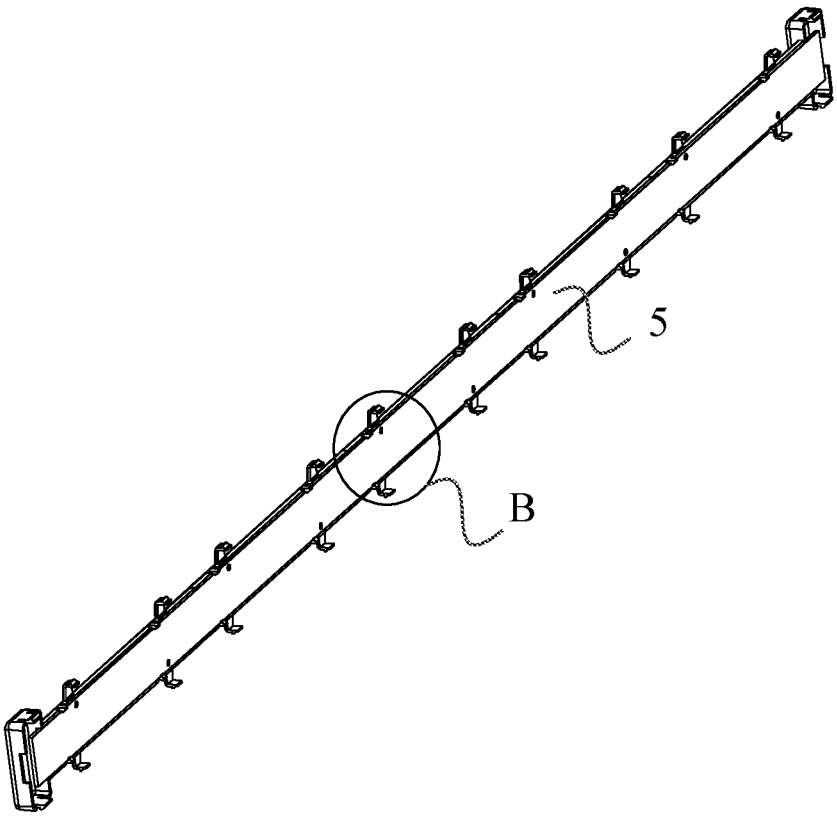
FIG. 5 is a rear view structural schematic diagram of the lens body provided with the LED light source provided by the example of the present disclosure.

As shown in FIG. 3 and FIG. 4, the first clamping lug 31 can have a board structure. In particular, the first clamping lug 31 can have a long slat structure, to facilitate processing. The first clamping lug 31 has a front end connected with the lens body 2, and a rear end provided with a protrusion 311. After the first clamping lug 31 is connected with the lens body 2, the first clamping lug 31 can be located on the rear surface of the lens body 2 and be substantially perpendicular to the lens body 2. Therefore, it is convenient for clamping the protrusion 311 of the first clamping lug 31 into the clamp slot 41 when connecting the lens body 2 and the base plate 1. The structure is simple and convenient to use.

The lens body 2 can be provided thereon with a plurality of first clamping lugs 31, and each of the first clamping lugs 31 is clamped with a different clamp slot 41 to improve firmness of fixing the lens body 2. When the lens body 2 has a strip structure or a ring structure, a plurality of first clamping lugs 31 can be provided on both sides of the lens body 2, and the first clamping lugs 31 located on both sides of the lens body 2 can be provided in pairs to further improve firmness of fixing the lens body 2. The first clamping lugs 31 located on both sides of the lens body 2 are arranged in pairs, which means, two first clamping lugs 31 in a pair are located on a same straight line perpendicular to an axis of the lens body 2 when the lens body 2 has a strip structure. Two first clamping lugs 31 in a pair are located on a same straight line passing through a center point of the lens body 2 when the lens body 2 has a ring structure.

Corresponding to the structure of the first clamping lug 31, the clamp slot 41 is a hole with axis perpendicular to the base plate 1. In particular, the clamp slot 41 can be a via hole running through a front surface and a rear surface of the base plate 1. When clamping the first clamping lug 31, the protrusion 311 passes through the clamp slot 41 and abuts against the rear surface of the base plate 1.

Figure 6:
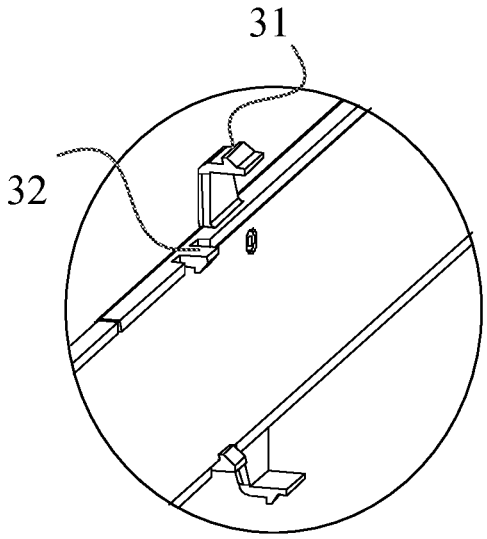
FIG. 6 is an enlarged view of a portion B of FIG. 5.

As shown in FIG. 5 and FIG. 6, the second clamping lug 32 and the first clamping lug 31 are provided separately to facilitate processing of the first clamping lug 31 and the second clamping lug 32. The second clamping lug 32 also has a board structure. In particular, the second clamping lug 32 can have a long slat structure, to facilitate processing. The second clamping lug 32 has a front end connected with the lens body 2, and a rear end provided with a protrusion. After the second clamping lug 32 is connected with the lens body 2, the second clamping lug 32 and the first clamping lug 31 are located on a same surface of the lens body 2 (the second clamping lug 32 is also located on the rear surface of the lens body 2), and the second clamping lug 32 is substantially perpendicular to the lens body 2. Such arrangement is simple in structure and convenient for processing with low costs.

During specific use of the second clamping lug 32, when the lens body 2 has a strip structure, a recessed receiving slot (not shown) for the LED light source 5 can be provided on the rear surface of the lens body 2, and an end of the receiving slot is provided with an insertion opening. The protrusion of the second clamping lug 32 is located on a side wall of the receiving slot. When fixing the LED light source 5, the LED light source 5 is pushed into the receiving slot from the insertion opening of the receiving slot, and the LED light source 5 is clamped by the protrusion of the second clamping lug 32. In order to further improve firmness of fixing the LED light source 5, an end cover 21 can be fixed at the opening of the receiving slot (as shown in FIG. 3). In this case, the protrusion of the second clamping lug 32 and the board body of the second clamping lug 32 can be fixedly connected with each other, for example, the two can be an integrally processed structure.

When the lens body 2 has a ring structure, a recessed receiving slot for the LED light source 5 can be provided on the rear surface of the lens body 2. The protrusion of the second clamping lug 32 can be arranged to be rotatable around the board body of the second clamping lug 32. When fixing the LED light source 5, the protrusion is rotated up, and the LED light source 5 is placed in the receiving slot. After the LED light source 5 is well placed, the protrusion is laid down, so as to clamp the LED light source 5 by the protrusion.

Figure 2:
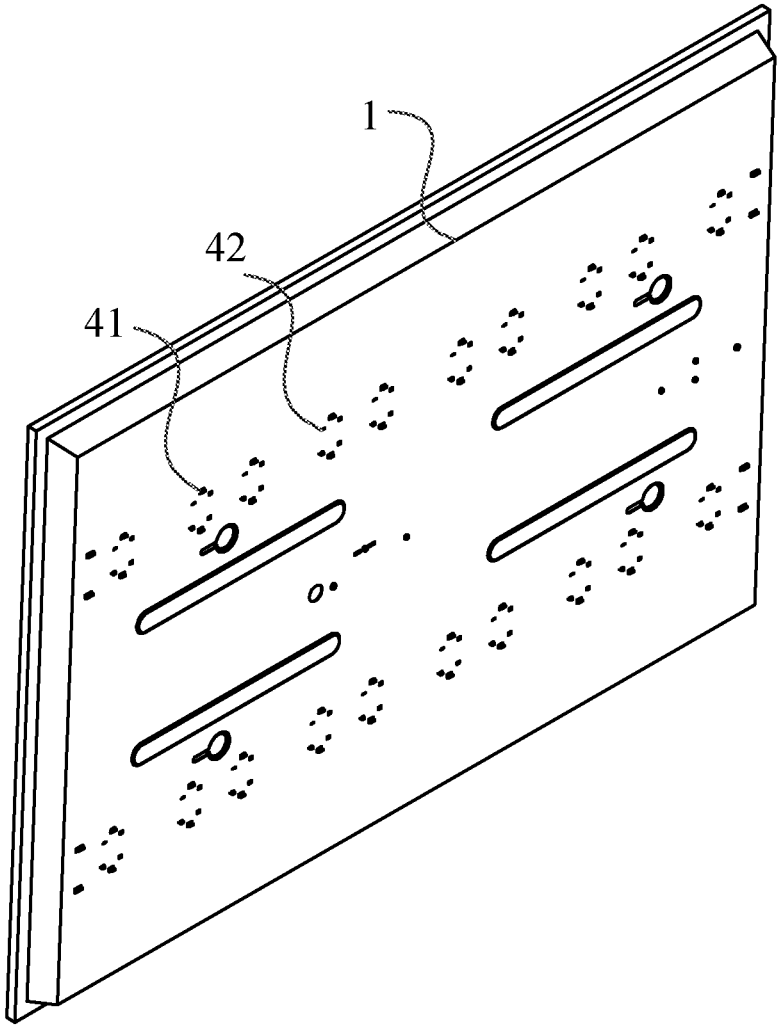
FIG. 2 is a structural schematic diagram of a rear surface of the LED lighting fixture provided by the example of the present disclosure.
Figure 7:
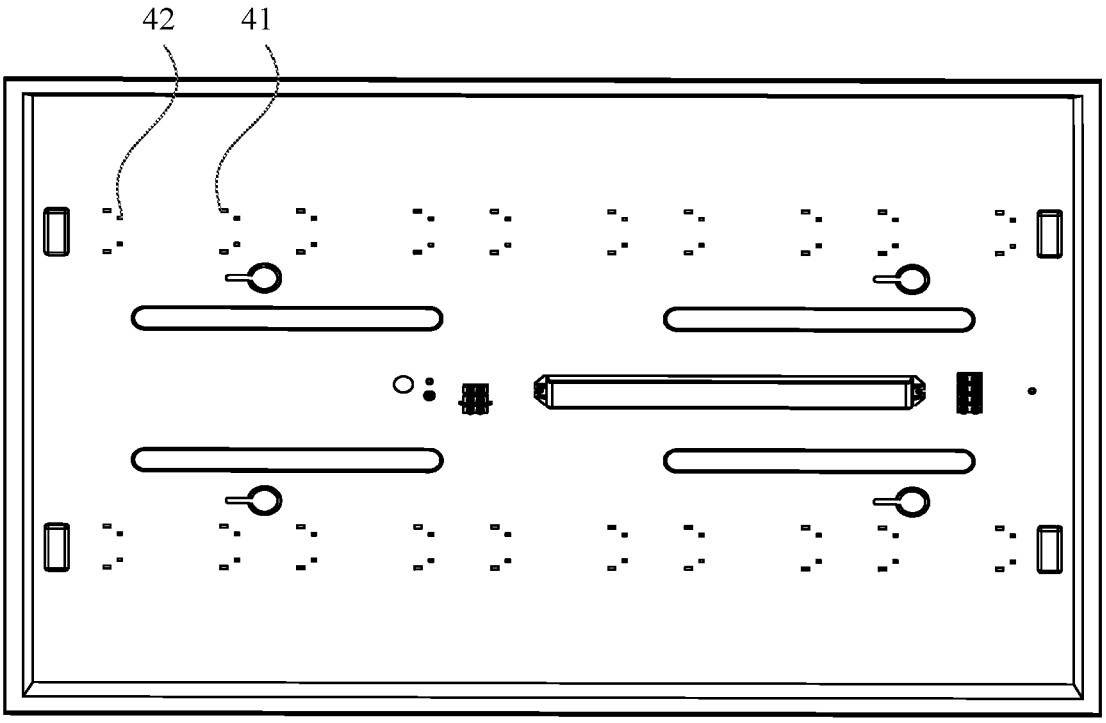
FIG. 7 is a front view structural schematic diagram of a base plate provided by the example of the present disclosure.

As shown in FIG. 2 and FIG. 7, when the second clamping lug 32 is perpendicular to the lens body 2, an avoidance slot 42 for the second clamping lug 32 can be provided on the base plate 1, to facilitate to clamp the lens body 2 with the base plate 1 by the first clamping lug 31. The avoidance slot 42 and the clamp slot 41 can be structures provided separately, to facilitate processing of the avoidance slot 42 and the clamp slot 41.

In addition, the second clamping lug 32 and the avoidance slot 42 can be in an interference fit. A maximum cross-sectional area of the second clamping lug 32 can be slightly larger than a cross-sectional area of the avoidance slot 42; and when the second clamping lug 32 is inserted into the avoidance slot 42, interference fit is implemented. In this way, the second clamping lug 32 can assist in connecting the base plate 1 and the lens body 2, to improve firmness of fixing the lens body 2 on the base plate 1 and reduce possibility of fracture of the first clamping lug 31 due to excessive force.

In this case, the lens body 2 can also be provided thereon with a plurality of second clamping lugs 32. In at least part of the pairs of first clamping lugs 31, one second clamping lug 32 can be provided on a same side of each of the first clamping lugs 31. A distance between each of the first clamping lugs 31 and a corresponding second clamping lug 32 is 2 mm to 5 mm. Such arrangement facilitates clamping the first clamping lug 31 in the clamp slot 41 and disposing the second clamping lug 32 in the avoidance slot 42, and further allows the second clamping lug 32 to assist in supporting the first clamping lug 31, so as to reduce possibility of fracture of the first clamping lug 31 due to excessive force.

The first clamping lug 31, the second clamping lug 32 and the lens body 2 can be an integrally molded structure. The first clamping lug 31 and the second clamping lug 32 are formed while the lens body 2 is processed, so as to facilitate processing the respective components to reduce costs.

A lens module according to the present disclosure includes a base plate 1 and a lens body 2 connected with the base plate 1 through a lamp fastener. Wherein, the lamp fastener is the above-described lamp fastener. In the lens module, the lens body 2 is connected with the base plate 1 through the first clamping lug 31 and the clamp slot 41, which, thus, as compared with screwing, consumes less time, and can improve mounting efficiency of the LED lighting fixture, to save time and labor.

The lens body 2 can have a strip structure. The lens body 2 is provided with a receiving slot for receiving the LED light source 5. An insertion opening for inserting the LED light source 5 is provided at an end portion of the receiving slot; and second clamping lugs 32 are located on both sides of the receiving slot. When the LED light source 5 needs to be mounted, the LED light source 5 is inserted into the receiving slot through the insertion opening, and the LED light source 5 is fixed by the second clamping lugs 32. In order to improve firmness of fixing the LED light source 5, an end cover 21 can be provided at a position of the insertion opening of the receiving slot. Of course, the lens body 2 can also have a ring structure.

An LED lighting fixture according to the present disclosure includes a lens module provided with a base plate 1 and a lens body 2 connected with the base plate 1, and an LED light source 5 connected with the lens body 2, wherein the lens module is the above-described lens module. That is, the lens body 2 is connected with the base plate 1 and the LED light source 5 through a lamp fastener, and the lamp fastener is the above-described lamp fastener. In the LED lighting fixture. The lens body 2 is connected with the base plate 1 by the first clamping lug 31 and the clamp slot 41, and the LED light source 5 is clamped onto the lens body 2 by the second clamping lug 32, which, thus, as compared with screwing, consumes less time, and can improve mounting efficiency of the LED lighting fixture, to save time and labor.

The lens body 2 can have a strip structure. The lens body 2 is provided thereon with a receiving slot for receiving the LED light source 5. An insertion opening for inserting the LED light source 5 is provided at an end portion of the receiving slot; and second clamping lugs 32 are located on both sides of the receiving slot. When the LED light source 5 needs to be mounted, the LED light source 5 is inserted into the receiving slot through the insertion opening, and the LED light source 5 is fixed by the second clamping lugs 32. In order to improve firmness of fixing the LED light source 5, an end cover 21 can be provided at a position of the insertion opening of the receiving slot. Of course, the lens body 2 can also have a ring structure.

Optionally, the first clamping lug and the second clamping lug are both connected with the lens body; the first clamping lug and the second clamping lug are provided separately; the first clamping lug and the second clamping lug are both located on a same surface of the lens body and are perpendicular to the lens body.

Optionally, wherein an avoidance slot for the second clamping lug is provided on the base plate.

Optionally, the clamp slot and the avoidance slot are provided separately.

Optionally, the second clamping lug and the avoidance slot are in an interference fit.

Optionally, the first clamping lugs are provided in plural and arranged in pairs on both sides of the lens body; and in at least a part of the pairs of the first clamping lugs, each of the first clamping lugs, on a same side thereof, is correspondingly provided one second clamping lug.

Optionally, a distance between each of the first clamping lugs and the second clamping lug corresponding thereto is 2 mm to 5 mm.

Optionally, the first clamping lug is a board body with a rear end connected to the lens body and a front end provided with a protrusion to be inserted into the clamp slot, The second clamping lug is a board body with a rear end connected to the lens body and a front end provided with a protrusion for clamping the LED light source.

Optionally, the lens body is of a strip structure and is provided with a receiving slot for receiving the LED light source of the LED lighting fixture; an insertion opening for inserting the LED light source is provided at an end portion of the receiving slot; and the second clamping lugs are located on both sides of the receiving slot.

The above are only examples of the present disclosure, and not intended to limit the present disclosure. For those skilled in the art, various changes and modifications can be made to the present disclosure. Any modifications, equivalent alternations and improvements without departing from the spirit and principle of the present disclosure shall be included within the protection scope thereof.

The invention claimed is:

1. A lamp fastener, comprising:

a first clamping lug and a clamp slot, configured for fixing a base plate and a lens body of a light-emitting diode (LED) lighting fixture; and a second clamping lug, configured for clamping an LED light source of the LED lighting fixture onto the lens body, wherein the second clamping lug and an avoidance slot on the base plate are in an interference fit and the interference fit comprises a maximum cross-sectional area of the second clamping lug that is larger than a cross-sectional area of the avoidance slot, and when the second clamping lug is inserted into the avoidance via the interference fit, a firmness of the lens body to the base plate is improved, and a possibility of fracture of the first clamping lug is reduced.

2. The lamp fastener according to claim 1, wherein the first clamping lug and the second clamping lug are both connected with the lens body; the first clamping lug and the second clamping lug are disposed separately; the first clamping lug and the second clamping lug are both located on a same surface of the lens body and are perpendicular to the lens body.

3. The lamp fastener according to claim 2, wherein the clamp slot and the avoidance slot are disposed separately.

4. The lamp fastener according to claim 2, wherein the first clamping lugs are provided in plural and arranged in pairs on both sides of the lens body; and in at least a part of the pairs of the first clamping lugs, each of the first clamping lugs, on a same side thereof, is correspondingly provided one second clamping lug.

5. The lamp fastener according to claim 4, wherein a distance between each of the first clamping lugs and the second clamping lug corresponding thereto is 2 mm to 5 mm.

6. The lamp fastener according to claim 2, wherein the first clamping lug is a board body with a rear end connected to the lens body and a front end provided with a protrusion to be inserted into the clamp slot, the second clamping lug is a board body with a rear end connected to the lens body and a front end provided with a protrusion for clamping the LED light source.

7. A lens module of an LED lighting fixture, comprising:

a base plate and a lens body connected with the base plate by a lamp fastener, wherein the lamp fastener comprises:

a first clamping lug and a clamp slot, configured for fixing the base plate and the lens body of the LED lighting fixture; and a second clamping lug, configured for clamping an LED light source of the LED lighting fixture onto the lens body, wherein the second clamping lug and an avoidance slot on the base plate are in an interference fit and the interference fit comprises a maximum cross-sectional area of the second clamping lug that is larger than a cross-sectional area of the avoidance slot, and when the second clamping lug is inserted into the avoidance via the interference fit, a firmness of the lens body to the base plate is improved, and a possibility of fracture of the first clamping lug is reduced.

8. The lens module according to claim 7, wherein the first clamping lug and the second clamping lug are both connected with the lens body; the first clamping lug and the second clamping lug are disposed separately; the first clamping lug and the second clamping lug are both located on a same surface of the lens body and are perpendicular to the lens body.

9. The lens module according to claim 8, wherein the clamp slot and the avoidance slot are disposed separately.

10. The lens module according to claim 8, wherein the first clamping lugs are provided in plural and arranged in pairs on both sides of the lens body; and in at least a part of the pairs of the first clamping lugs, each of the first clamping lugs, on a same side thereof, is correspondingly provided one second clamping lug.

11. The lens module according to claim 7, wherein the lens body is of a strip structure and is provided with a receiving slot for receiving the LED light source of the LED lighting fixture; an insertion opening for inserting the LED light source is provided at an end portion of the receiving slot; and the second clamping lugs are located on both sides of the receiving slot.

12. An LED lighting fixture, comprising a lens module, and an LED light source provided on the lens module, wherein the lens module comprises:

a base plate and a lens body connected with the base plate by a lamp fastener, wherein the lamp fastener comprises:

a first clamping lug and a clamp slot, configured for fixing the base plate and the lens body of the LED lighting fixture; and a second clamping lug, configured for clamping an LED light source of the LED lighting fixture onto the lens body, wherein the second clamping lug and an avoidance slot on the base plate are in an interference fit and the interference fit comprises a maximum cross-sectional area of the second clamping lug that is larger than a cross-sectional area of the avoidance slot, and when the second clamping lug is inserted into the avoidance via the interference fit, a firmness of the lens body to the base plate is improved, and a possibility of fracture of the first clamping lug is reduced.

13. The LED lighting fixture according to claim 12, wherein the first clamping lug and the second clamping lug are both connected with the lens body; the first clamping lug and the second clamping lug are disposed separately; the first clamping lug and the second clamping lug are both located on a same surface of the lens body and are perpendicular to the lens body.

14. The LED lighting fixture according to claim 13, wherein the clamp slot and the avoidance slot are disposed separately.

15. The LED lighting fixture according to claim 12, wherein the first clamping lugs are provided in plural and arranged in pairs on both sides of the lens body; and in at least a part of the pairs of the first clamping lugs, each of the first clamping lugs, on a same side thereof, is correspondingly provided one second clamping lug.

* * * * *